US011712061B2

(12) United States Patent
Alarcon

(10) Patent No.: US 11,712,061 B2
(45) Date of Patent: Aug. 1, 2023

(54) ELECTRONIC CIGARETTE CARRIER

(71) Applicant: Fontem Holdings 2 B.V., Amsterdam (NL)

(72) Inventor: Ramon Alarcon, Los Gatos, CA (US)

(73) Assignee: Fontem Ventures B.V., Amsterdam (NL)

( * ) Notice: Subject to any disclaimer, the term of this patent is extended or adjusted under 35 U.S.C. 154(b) by 115 days.

(21) Appl. No.: 17/189,012

(22) Filed: Mar. 1, 2021

(65) Prior Publication Data

US 2021/0177051 A1 Jun. 17, 2021

Related U.S. Application Data

(62) Division of application No. 16/087,826, filed as application No. PCT/IB2017/057964 on Dec. 14, 2017, now abandoned.

(60) Provisional application No. 62/434,703, filed on Dec. 15, 2016.

(51) Int. Cl.

| | |
|---|---|
| ***A24F 15/01*** | (2020.01) |
| ***A24F 9/16*** | (2006.01) |
| ***B65D 25/54*** | (2006.01) |
| ***B65D 43/16*** | (2006.01) |

(52) U.S. Cl.

CPC ..... *A24F 15/01* (2020.01); *A24F 9/16* (2013.01); *B65D 25/54* (2013.01); *B65D 43/162* (2013.01)

(58) Field of Classification Search

CPC . A24F 15/01; A24F 9/16; A24F 15/14; B65D 25/54; B65D 43/162

USPC ..... 206/261

See application file for complete search history.

(56) References Cited

U.S. PATENT DOCUMENTS

| | | | | |
|---|---|---|---|---|
| 1,131,856 | A * | 3/1915 | O'Donnell | G07F 11/045 221/232 |
| 1,167,110 | A * | 1/1916 | Poeppel | G07F 11/045 221/232 |
| 1,220,496 | A | 3/1917 | Carr | |
| 1,379,659 | A * | 5/1921 | Talbot | A24F 15/14 221/232 |
| 2,929,542 | A | 3/1960 | O'Gorman | |
| 3,035,299 | A | 5/1962 | Gordon | |
| 3,061,146 | A | 10/1962 | Nyerges et al. | |
| 3,214,009 | A | 10/1965 | Tamarin | |
| 3,249,212 | A | 5/1966 | Tamarin | |
| 3,272,321 | A | 9/1966 | Tamarin | |
| 3,282,465 | A | 11/1966 | Davis | |
| 5,564,442 | A * | 10/1996 | MacDonald | A24F 40/40 131/194 |
| 5,676,990 | A | 10/1997 | Wawrzynski | |
| 6,125,082 | A | 9/2000 | Reid | |
| 7,712,630 | B2 | 5/2010 | He | |
| 2007/0246382 | A1 | 10/2007 | He | |
| 2014/0097103 | A1 | 4/2014 | Cameron | |
| 2016/0050975 | A1 | 2/2016 | Worm et al. | |
| 2016/0101909 | A1 * | 4/2016 | Schennum | B65D 43/16 206/268 |

* cited by examiner

*Primary Examiner* — J. Gregory Pickett
*Assistant Examiner* — Jenine Pagan
(74) *Attorney, Agent, or Firm* — Dykema Gossett PLLC

(57) ABSTRACT

Aspects of the instant disclosure relate to carrying and dispensing electronic cigarettes, electronic cigarette components, and electronic cigarette accessories; and more particularly for dispensing an electronic cigarette while one or more electronic cigarettes and electronic cigarette components remain secured within a carrier.

13 Claims, 9 Drawing Sheets

ELECTRONIC CIGARETTE CARRIER

CROSS-REFERENCE TO RELATED APPLICATIONS

This application is a divisional of U.S. application Ser. No. 16/087,826, filed 24 Sep. 2018, which is a national stage filing based upon International PCT Application No. PCT/IB2017/057964, filed 14 Dec. 2017, which claims the benefit of priority to U.S. application No. 62/434,703, filed 15 Dec. 2016, the entire disclosures of which are incorporated herein in their entirety.

BACKGROUND

Field

The present disclosure relates to electronic cigarette carriers for carrying and dispensing electronic cigarettes, electronic cigarette components, and electronic cigarette accessories. Further aspects of the present disclosure are directed to dispensing an electronic cigarette while one or more electronic cigarettes and electronic cigarette components remain secured within the carrier.

Background Art

Electronic cigarettes, also known as e-cigarettes (eCigs) and personal vaporizers (PVs), are electronic inhalers that vaporize or atomize a liquid solution into an aerosol mist, which is inhaled by a user. A typical rechargeable eCig has two main parts—a battery housing and a cartomizer. The battery housing typically includes a battery, a light emitting diode (LED), and a pressure sensor. The cartomizer typically includes a liquid solution, an atomizer, and a mouthpiece. The atomizer typically includes a heating coil that vaporizes the liquid solution.

To recharge the battery, a universal serial bus (USB) charger can be utilized which draws power from a computer or other power supply, converts the supplied power to the desired input for the battery, and supplies the desired input to the battery. In use, a user draws air through the atomizer, via the mouthpiece, to activate a heating coil that vaporizes the liquid solution into the air being drawn. After a number of draws, the battery must be recharged. Similarly, after a number of draws, the liquid solution within the cartomizer is depleted and must be replaced with another cartomizer. Consequently, many users transport one or more cartomizers, the battery housing, and a charger, which are frequently accessed by the user.

BRIEF SUMMARY

In one embodiment of the present disclosure, an electronic cigarette carrier for enclosing, and accessing an electronic cigarette is disclosed. The electronic cigarette carrier includes an electronic cigarette enclosure for enclosing electronic cigarettes therein, and a retention feature. The retention feature is releasably coupled to an exterior surface of the electronic cigarette carrier adjacent the electronic cigarette enclosure and provides access to the electronic cigarette, while also enclosing the electronic cigarette enclosure when the electronic cigarette is retracted into the enclosure. An external manipulation access window extends between the exterior surface of the electronic cigarette carrier and the electronic cigarette enclosure to allow for access to and external manipulation of the electronic cigarette into and out of the enclosure.

In another embodiment, a system for enclosing and accessing an electronic cigarette is disclosed. The system includes an electronic cigarette carrier with an electronic cigarette enclosure for enclosing the eCig, and an opening extending between the enclosure and an exterior surface of the carrier. A retention feature, coupled to the carrier, seals the electronic cigarette enclosure when retracted. An access mechanism actuates the retention feature, extends the electronic cigarette out of the enclosure, and retracts the retention feature to seal the enclosure of the carrier.

Various aspects of the present disclosure are directed to embodiments of an eCig carrier that includes a top portion with a compliant material, and a bottom portion with a non-compliant material. The top and bottom portions form an electronic cigarette enclosure, and frictionally couple the eCig to the enclosure. An interface between the top and bottom portions of the carrier extends axially along the length of the enclosure, and an opening at one end of the enclosure extends to an exterior surface of the housing. In response to a first compression force applied transverse to a plane of the interface, the top portion is deformed relative to the bottom portion. This deformation of the top portion reduces the frictional coupling between the electronic cigarette and the enclosure releasing the eCig from the enclosure via the opening.

Additional features, advantages, and embodiments of the disclosure may be set forth or apparent from consideration of the detailed description and drawings. Moreover, it is to be understood that the foregoing summary of the disclosure and the following detailed description and drawings are exemplary and intended to provide further explanation without limiting the scope of the disclosure as claimed.

BRIEF DESCRIPTION OF THE DRAWINGS

Various example embodiments may be more completely understood in consideration of the following detailed description in connection with the accompanying drawings.

Figure 1:
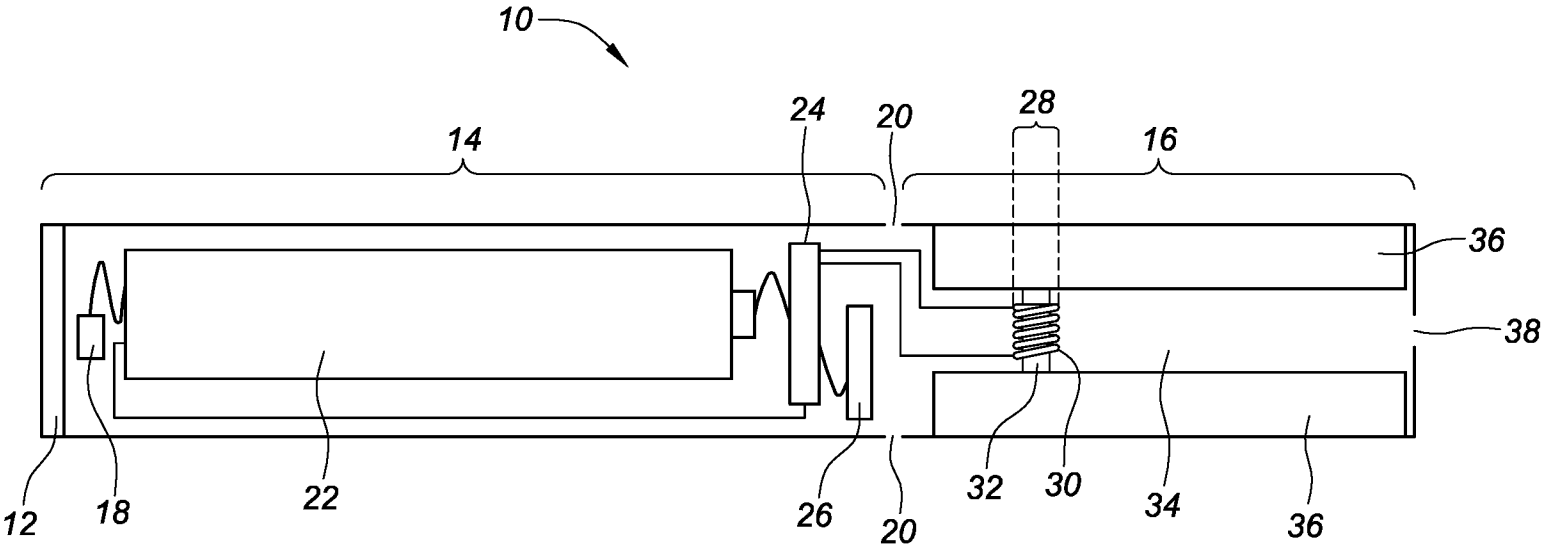
FIG. 1 is a schematic cross-sectional illustration of an exemplary e-cigarette.

While various embodiments discussed herein are amenable to modifications and alternative forms, aspects thereof have been shown by way of example in the drawings and will be described in detail. It should be understood, however, that the intention is not to limit the disclosure to the particular embodiments described. On the contrary, the intention is to cover all modifications, equivalents, and alternatives falling within the scope of the disclosure including aspects defined in the claims.

DETAILED DESCRIPTION OF THE DISCLOSURE

The disclosure and the various features and advantageous details thereof are explained more fully with reference to the non-limiting embodiments and examples that are described and/or illustrated in the accompanying drawings and detailed in the following. It should be noted that the features illustrated in the drawings are not necessarily drawn to scale, and features of one embodiment may be employed with other embodiments as the skilled artisan would recognize, even if not explicitly stated herein. Descriptions of well-known components and processing techniques may be omitted so as to not unnecessarily obscure the embodiments of the disclosure. The examples used herein are intended merely to facilitate an understanding of ways in which the disclosure may be practiced and to further enable those of skill in the art to practice the embodiments of the disclosure. Accordingly, the examples and embodiments herein should not be construed as limiting the scope of the disclosure. Moreover, it is noted that like reference numerals represent similar parts throughout the several views of the drawings.

Throughout the following, an electronic smoking device will be exemplarily described with reference to an e-cigarette. As is shown in FIG. 1, an e-cigarette 10 typically has a housing comprising a cylindrical hollow tube having an end cap 12. The cylindrical hollow tube may be a single-piece or a multiple-piece tube. In FIG. 1, the cylindrical hollow tube is shown as a two-piece structure having a power supply portion 14 and an atomizer/liquid reservoir portion 16. Together the power supply portion 14 and the atomizer/liquid reservoir portion 16 form a cylindrical tube which can be approximately the same size and shape as a conventional cigarette, typically about 100 mm with a 7.5 mm diameter, although lengths may range from 70 to 150 or 180 mm, and diameters from 5 to 28 mm.

The power supply portion 14 and atomizer/liquid reservoir portion 16 are typically made of metal (e.g., steel or aluminum, or of hardwearing plastic) and act together with the end cap 12 to provide a housing to contain the components of the e-cigarette 10. The power supply portion 14 and the atomizer/liquid reservoir portion 16 may be configured to fit together by, for example, a friction push fit, a snap fit, a bayonet attachment, a magnetic fit, or screw threads. The end cap 12 is provided at the front end of the power supply portion 14. The end cap 12 may be made from translucent plastic or other translucent material to allow a light-emitting diode (LED) 18 positioned near the end cap to emit light through the end cap. Alternatively, the end cap may be made of metal or other materials that do not allow light to pass.

An air inlet may be provided in the end cap, at the edge of the inlet next to the cylindrical hollow tube, anywhere along the length of the cylindrical hollow tube, or at the connection of the power supply portion 14 and the atomizer/liquid reservoir portion 16. FIG. 1 shows a pair of air inlets 20 provided at the intersection between the power supply portion 14 and the atomizer/liquid reservoir portion 16.

A power supply, preferably a battery 22, the LED 18, control electronics 24 and, optionally, an airflow sensor 26 are provided within the cylindrical hollow tube power supply portion 14. The battery 22 is electrically connected to the control electronics 24, which are electrically connected to the LED 18 and the airflow sensor 26. In this example, the LED 18 is at the front end of the power supply portion 14, adjacent to the end cap 12; and the control electronics 24 and airflow sensor 26 are provided in the central cavity at the other end of the battery 22 adjacent the atomizer/liquid reservoir portion 16.

The airflow sensor 26 acts as a puff detector, detecting a user puffing or sucking on the atomizer/liquid reservoir portion 16 of the e-cigarette 10. The airflow sensor 26 can be any suitable sensor for detecting changes in airflow or air pressure, such as a microphone switch including a deformable membrane which is caused to move by variations in air pressure. Alternatively, the sensor may be, for example, a Hall element or an electro-mechanical sensor.

The control electronics 24 are also connected to an atomizer 28. In the example shown, the atomizer 28 includes a heating coil 30 which is wrapped around a wick 32 extending across a central passage 34 of the atomizer/liquid reservoir portion 16. The central passage 34 may, for example, be defined by one or more walls of the liquid reservoir and/or one or more walls of the atomizer/liquid reservoir portion 16 of the e cigarette 10. The coil 30 may be positioned anywhere in the atomizer 28 and may be transverse or parallel to a longitudinal axis of a cylindrical liquid reservoir 36. The wick 32 and heating coil 30 do not completely block the central passage 34. Rather an air gap is provided on either side of the heating coil 30 enabling air to flow past the heating coil 30 and the wick 32. The atomizer may alternatively use other forms of heating elements, such as ceramic heaters, or fiber or mesh material heaters. Nonresistance heating elements such as sonic, piezo, and jet spray may also be used in the atomizer in place of the heating coil.

The central passage 34 is surrounded by the cylindrical liquid reservoir 36 with the ends of the wick 32 abutting or extending into the liquid reservoir 36. The wick 32 may be a porous material such as a bundle of fiberglass fibers or cotton or bamboo yarn, with liquid in the liquid reservoir 36 drawn by capillary action from the ends of the wick 32 towards the central portion of the wick 32 encircled by the heating coil 30.

The liquid reservoir 36 may alternatively include wadding (not shown in FIG. 1) soaked in liquid which encircles the central passage 34 with the ends of the wick 32 abutting the wadding. In other embodiments, the liquid reservoir may comprise a toroidal cavity arranged to be filled with liquid and with the ends of the wick 32 extending into the toroidal cavity.

An air inhalation port 38 is provided at the back end of the atomizer/liquid reservoir portion 16 remote from the end cap 12. The inhalation port 38 may be formed from the cylindrical hollow tube atomizer/liquid reservoir portion 16 or may be formed in an end cap.

In use, a user sucks on the e-cigarette 10. This causes air to be drawn into the e cigarette 10 via one or more air inlets, such as air inlets 20, and to be drawn through the central passage 34 towards the air inhalation port 38. The change in air pressure which arises is detected by the airflow sensor 26, which generates an electrical signal that is passed to the control electronics 24. In response to the signal, the control electronics 24 activate the heating coil 30, which causes liquid present in the wick 32 to be vaporized creating an aerosol (which may comprise gaseous and liquid components) within the central passage 34. As the user continues to suck on the e-cigarette 10, this aerosol is drawn through the central passage 34 and inhaled by the user. At the same time, the control electronics 24 also activate the LED 18 causing the LED 18 to light up, which is visible via the translucent end cap 12. Activation of the LED may mimic the appearance of a glowing ember at the end of a conventional cigarette. As liquid present in the wick 32 is converted into an aerosol, more liquid is drawn into the wick 32 from the liquid reservoir 36 by capillary action and thus is available to be converted into an aerosol through subsequent activation of the heating coil 30.

Some e-cigarettes are intended to be disposable and the electric power in the battery 22 is intended to be sufficient to vaporize the liquid contained within the liquid reservoir 36, after which the e-cigarette 10 is thrown away. In other embodiments, the battery 22 is rechargeable and the liquid reservoir 36 is refillable. In the cases where the liquid reservoir 36 is a toroidal cavity, this may be achieved by refilling the liquid reservoir 36 via a refill port (not shown in FIG. 1). In other embodiments, the atomizer/liquid reservoir portion 16 of the e-cigarette 10 is detachable from the power supply portion 14 and a new atomizer/liquid reservoir portion 16 can be fitted with a new liquid reservoir 36 thereby replenishing the supply of liquid. In some cases, replacing the liquid reservoir 36 may involve replacement of the heating coil 30 and the wick 32 along with the replacement of the liquid reservoir 36. A replaceable unit comprising the atomizer 28 and the liquid reservoir 36 may be referred to as a cartomizer.

The new liquid reservoir may be in the form of a cartridge (not shown in FIG. 1) defining a passage (or multiple passages) through which a user inhales aerosol. In other embodiments, the aerosol may flow around the exterior of the cartridge to the air inhalation port 38.

Of course, in addition to the above description of the structure and function of a typical e-cigarette 10, variations also exist. For example, the LED 18 may be omitted. The airflow sensor 26 may be placed, for example, adjacent to the end cap 12 rather than in the middle of the e-cigarette. The airflow sensor 26 may be replaced by, or supplemented with, a switch which enables a user to activate the e-cigarette manually rather than in response to the detection of a change in air flow or air pressure.

Different types of atomizers may be used. Thus, for example, the atomizer may have a heating coil in a cavity in the interior of a porous body soaked in liquid. In this design, aerosol is generated by evaporating the liquid within the porous body either by activation of the coil heating the porous body or alternatively by the heated air passing over or through the porous body. Alternatively the atomizer may use a piezoelectric atomizer to create an aerosol either in combination or in the absence of a heater.

Figure 2A:
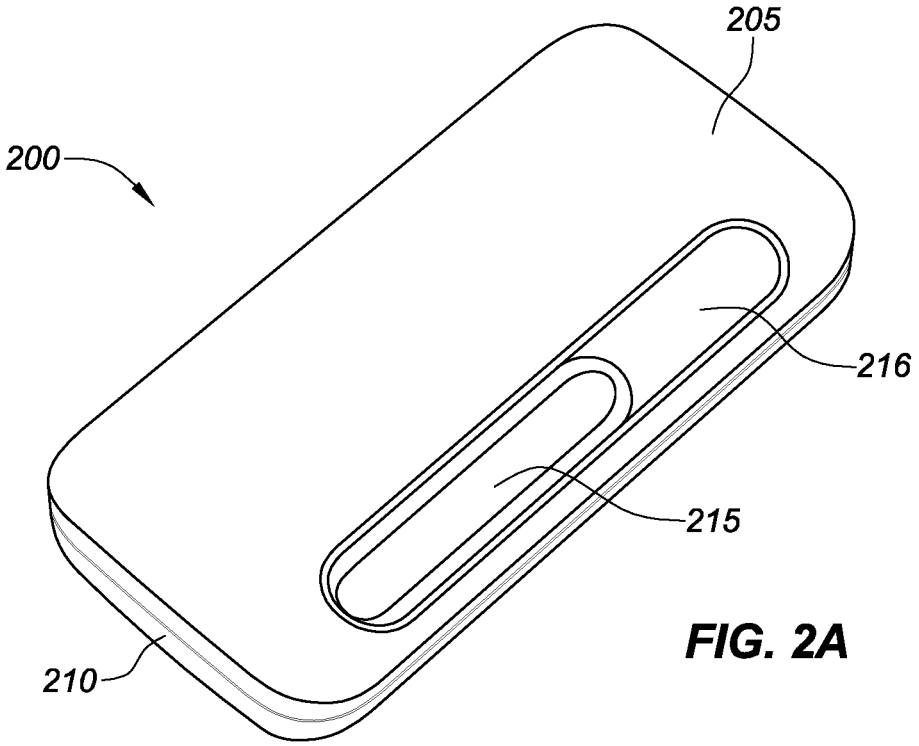
FIG. 2A is an isometric view of an electronic cigarette carrier, consistent with various aspects of the present disclosure.
Figure 2B:
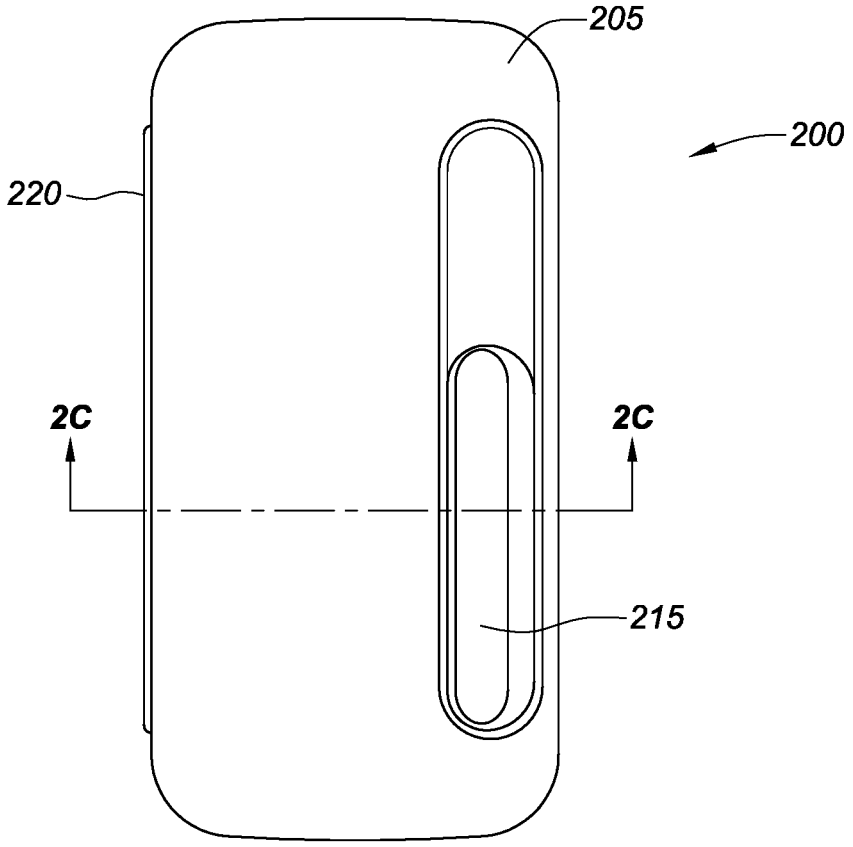
FIG. 2B is a front view of the electronic cigarette carrier of FIG. 2A, consistent with various aspects of the present disclosure.

FIGS. 2A and 2B show a couple views of an eCig carrier 200 including a top portion 205, bottom portion 210, and a living hinge 220. Such a carrier 200 is often referred to as a clam-shell case, as the living hinge couples the top portion, and the bottom portion at respective ends and allows the top and bottom portions to pivot relative to one another. The top portion 205 includes an external manipulation access window 215 which allows a user to manipulate and access an eCig within the eCig carrier 200. In one exemplary use of the external manipulation access window 215, the user may access an eCig within the eCig carrier via the external manipulation access window and using a linear motion coaxial with a length of the external manipulation access window to draw the eCig out of the eCig carrier 200. Grip 216 may extend around the external manipulation access window, and provide an ergonomic location for the user to grip the eCig carrier. In various embodiments, the grip may be inset from an exterior surface of the top portion. In further embodiments, the grip and the external manipulation access window 215 may be offset from one another, or on opposite sides of the eCig carrier. For example, the external manipulation access window may be on the top portion 205 and the grip on the bottom portion 210. In such a configuration, during use, the eCig carrier 200 may be operated with a single hand. The user's thumb manipulating the eCig within the eCig carrier via the external manipulation access window 215 and one or more other fingers curving around a side of the eCig carrier and into contact with the grip 216.

In further embodiments, an eCig carrier 200 may include opposing external manipulation access windows 215 on both a top portion 205 and a bottom portion 210 of the eCig carrier. The eCig carrier can also include opposing grips 216 on both the top and bottom portions, the grips extending (optionally) around at least a portion of the external manipulation access windows. The opposing external manipulation access windows 215 allow a user to access an eCig within the eCig carrier with one or more digits and to manipulate the eCig relative to the eCig carrier with a substantially linear motion coaxial to a length of the external manipulation access windows to draw the eCig out of the eCig carrier. The external manipulation access windows 215 and the grips 216 may also assist the user in opening the eCig carrier to access the eCig, eCig components, and eCig accessories within. It is to be understood that various mechanisms may be utilized to couple the top portion and bottom portion of the eCig carrier to one another. For example, latches, locks, various joints, magnets embedded in both the top and the bottom portions, etc.

Figure 2C:
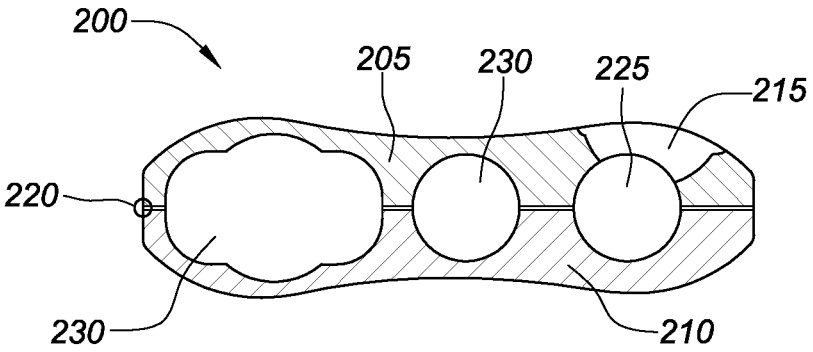
FIG. 2C is a cross-sectional top view of the electronic cigarette carrier of FIG. 2A, consistent with various aspects of the present disclosure.

FIG. 2C is a cross-sectional top view of electronic cigarette carrier 200 of FIG. 2A, consistent with various aspects of the present disclosure. FIG. 2C shows a top portion 205 and a bottom portion 210 of the eCig carrier axially coupled by a living hinge 220. In some embodiments, the living hinge may be fabricated with a material of a lower durometer than other portions of the eCig carrier to decrease the external force required to rotate the top and bottom portions relative to the living hinge. More specific embodiments further include enclosures 230 which provide locations within the eCig carrier for additional eCigs, eCig components such as extra cartomizers and housings, and eCig accessories such as chargers. ECig enclosure 225 can be accessible via external manipulation access window 215 allowing for linear manipulation of the eCig within the eCig enclosure. A user may access an eCig via the external manipulation access window to both extract and retract the eCig relative to the eCig enclosure 225.

In various embodiments of the present disclosure, walls of eCig enclosure 225 can be textured to optimize the friction coefficient between the walls of the eCig enclosure and an eCig housed within the eCig enclosure. Additional aspects of eCig carrier 200 may also be varied to further affect the coefficient of friction between the walls of the eCig enclosure and the eCig; for example, variation in material durometer and wall thicknesses. In some embodiments, it can be desirable to have an increased coefficient of friction to minimize unintended release of the eCig from the eCig carrier 200 in response to external forces on the eCig carrier (e.g., being dropped, vehicle vibration, and movement within a user's pocket). In other embodiments, a reduced coefficient of friction can be desirable to reduce the exertion force required on the eCig via the external manipulation access window 215 to release the eCig from the eCig enclosure 225. For example, in some applications the user can exert an external force against the eCig carrier 200 (e.g., impacting a bottom end of the eCig carrier), and in response to the force, the eCig carrier releases an eCig from within the eCig enclosure 225 by overcoming a coefficient of friction between the eCig and the walls of the eCig enclosure (and a gate, as discussed in more detail below).

Figure 2D:
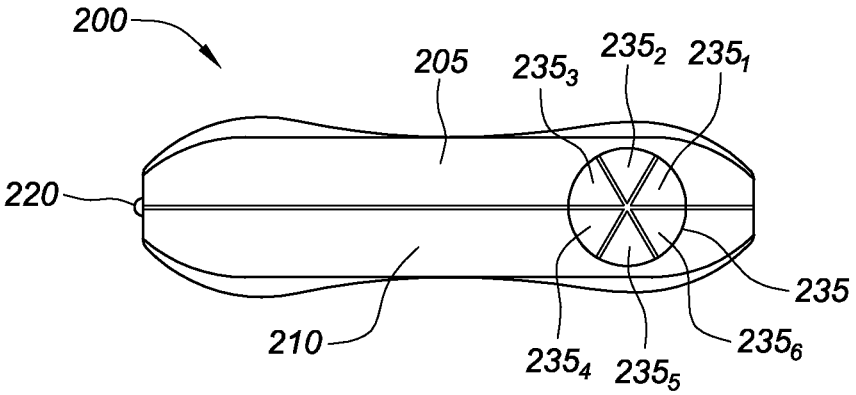
FIG. 2D is a top view of the electronic cigarette carrier of FIG. 2A, consistent with various aspects of the present disclosure.

FIG. 2D is a top view of the electronic cigarette carrier 200 of FIG. 2A including gate 235 which encloses a portion of eCig enclosure 225 (as shown in FIG. 2C) from an external environment. In various embodiments, the gate can be a compliant material (low durometer) that deforms in response to the application of a force (e.g., the extension of an eCig from the eCig enclosure, or the retraction of the eCig into the eCig enclosure). When deformed, the gate provides an access point to the eCig stored within the eCig enclosure. In some embodiments, it can be desirable to decrease the compliance of the gate (by increasing the durometer of the material used for the gate) to minimize unintended release of the eCig from the eCig carrier 200 in response to external forces (e.g., being dropped, vehicle vibration, and movement within a user's pocket). As shown in FIG. 2D, the gate can include multiple gate portions $\mathbf{235}_{1\text{-}6}$ that act together to both enclose the eCig enclosure 225, and deform in response to the eCig being accessed. The multiple gate portions may extend from an outer circumference of the eCig enclosure and take any number of shapes. In specific embodiments, the shape of the multiple gate portions can be based on maximizing deflection of the multiple gate portions in response to a force exerted thereon.

In various embodiments of the present disclosure, a user can exert an external force against the eCig carrier 200 (e.g., tapping the eCig carrier), and in response to the force, the eCig enclosure 225 releases an eCig from within the eCig carrier. Such embodiments utilize an impact-based release system, where the impact force on the eCig carrier must overcome a coefficient of friction between the eCig and the walls of the eCig enclosure 225 and deform gate 235 to allow the eCig to exit. Impact-based release systems consistent with aspects of the present disclosure can have a range of minimum threshold eCig escape force values based on a combination of the static and kinetic coefficients of friction between the eCig and the eCig enclosure 225, and material properties of the gate 235. The static and kinetic coefficients of friction can be varied based on surface finishes and hardness of both the eCig enclosure 225 and the eCig, itself, as well as the relative clearance between the eCig and the eCig enclosure. The deformational properties of the gate are related at least in part to the durometer of the material used for the gate (portions), the thickness and length of the gate, and a torque placed on the gate by the eCig which is highly dependent on the gate design. Accordingly, when an impact is exerted upon the eCig enclosure 225, the resulting vector force (also referred to as the eCig escape force) that is axial to the eCig enclosure must be greater than a sum of: the initial static frictional force between the eCig and the eCig enclosure, the kinetic frictional force exerted on the eCig enclosure as it moves through the eCig enclosure, and the deformation force of the gate.

In further embodiments of an impact-based release system, multiple impacts against eCig carrier 200 may be required in order for an eCig within the eCig carrier to be released from an enclosure 225 of the eCig carrier. For example, multiple impacts are required where the impact force of each impact is less than an eCig escape force.

Figure 3A:
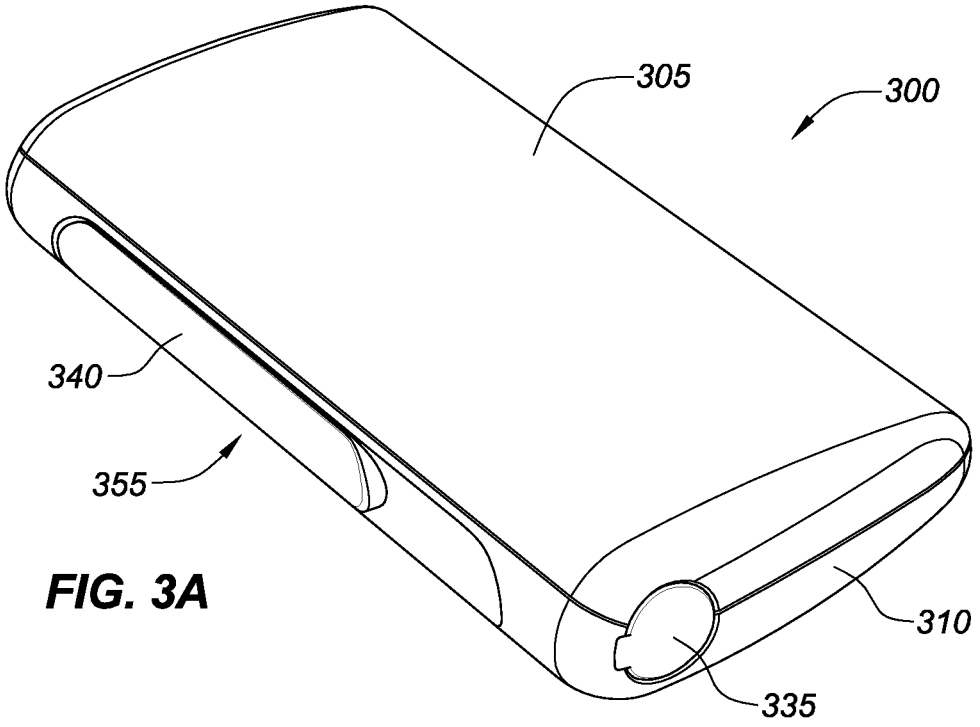
FIG. 3A is an isometric view of a second embodiment of an electronic cigarette carrier, consistent with various aspects of the present disclosure.

FIG. 3A is an isometric view of an electronic cigarette carrier 300, consistent with various aspects of the present disclosure. The electronic cigarette carrier includes a top portion 305 and a bottom portion 310 rotatably coupled to one another via a hinge 320 (shown in FIGS. 3C-D). An access mechanism 355 includes a control 340, a trolley 356 (as shown in FIG. 3C), and a retention feature 335. The access mechanism can be activated, for example, by the application of an external force on the control. The application of the external force on the control causes simultaneous actuation of the retention feature and extension of an eCig 350 out of the eCig carrier 300 (as shown in FIG. 3E). In some embodiments, the access mechanism 355 can be spring-loaded and in response to the dissipation of the external force on the control, the retention feature (and trolley) is retracted. When retracted, the retention feature covers an access point to an eCig enclosure. Similarly, when inserting the eCig into the eCig carrier, the application of an external force on the control can actuate the retention feature. After partial insertion of the eCig into the enclosure, dissipation of the external force on the control can lower the eCig fully into the enclosure and retract the retention feature.

Figure 3B:
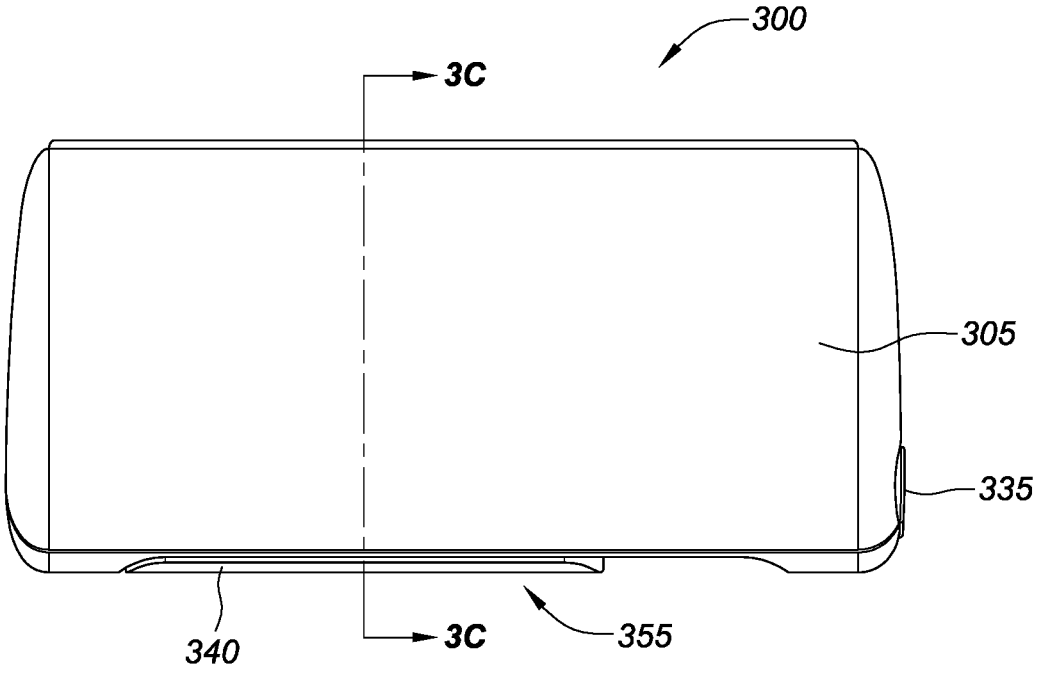
FIG. 3B is a front view of the electronic cigarette carrier of FIG. 3A, consistent with various aspects of the present disclosure.
Figure 3C:
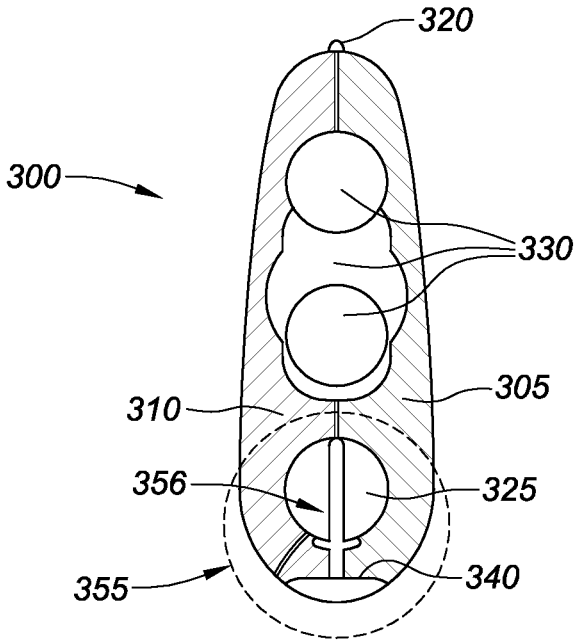
FIG. 3C is a cross-sectional top view of the electronic cigarette carrier of FIG. 3A, consistent with various aspects of the present disclosure.

FIG. 3B is a front view of the electronic cigarette carrier of FIG. 3A. It is to be understood that access mechanism 355 and control 340 can take a number of forms including electronic means, mechanical means, and a combination thereof. For example, the control can be an electronic switch that enables the access mechanism, including a linear actuator, to extend an eCig out of the eCig carrier 300 while simultaneously opening the retention feature 335. In yet other embodiments, the control can be a mechanical button that is coupled to and slides congruent with the access mechanism. The access mechanism can include a trolley 356 within an eCIg enclosure 325 for facilitating travel of the eCig within the carrier.

Figure 3D:
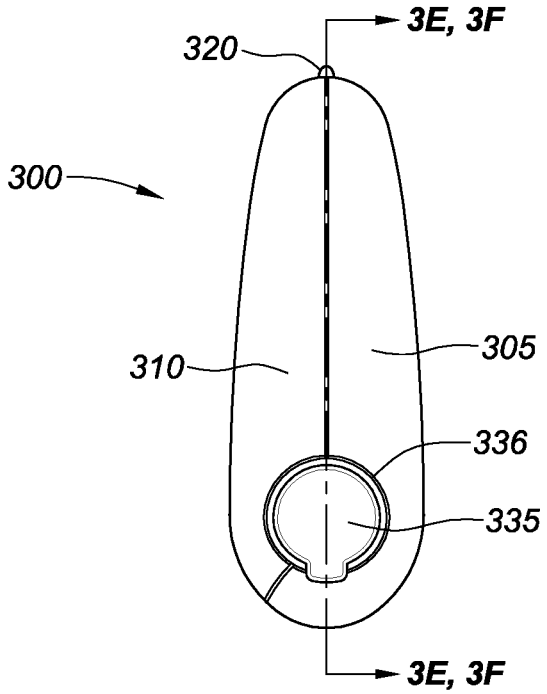
FIG. 3D is a top view of the electronic cigarette carrier of FIG. 3A, consistent with various aspects of the present disclosure.
Figure 3E:
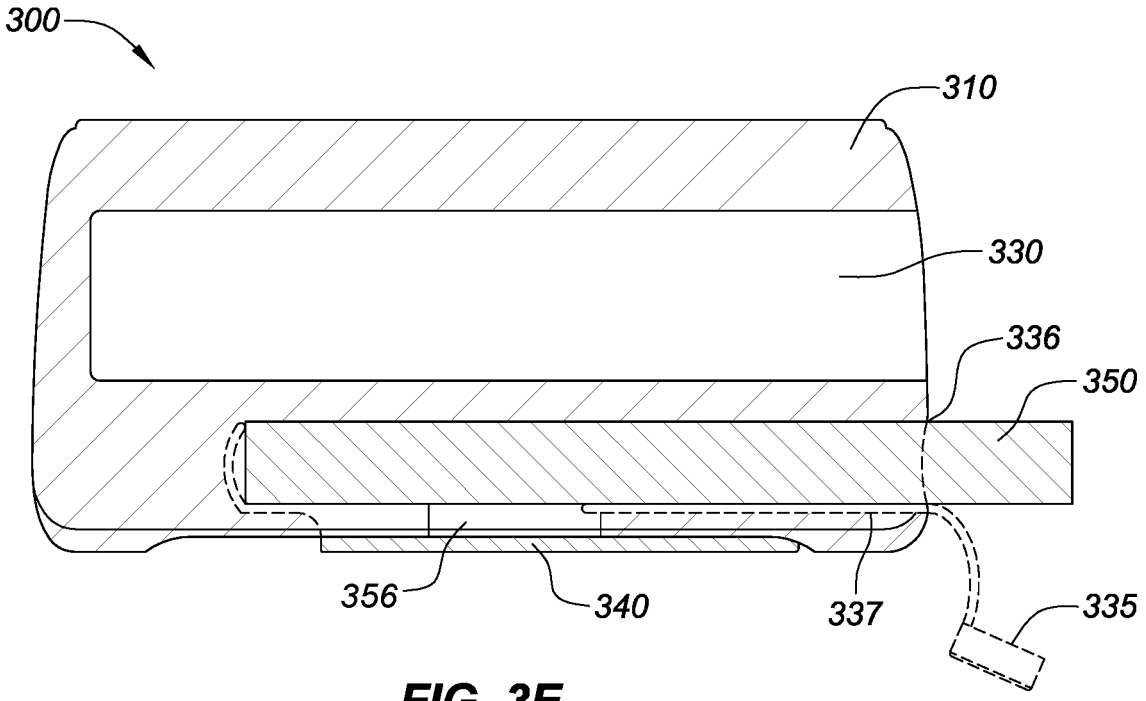
FIG. 3E is a cross-sectional front view of the electronic cigarette carrier of FIG. 3A with an electronic cigarette partially enclosed therein, consistent with various aspects of the present disclosure.

FIGS. 3C and 3D show a top view, and a cross-sectional top view, respectively, of electronic cigarette carrier 300 of FIG. 3A. The eCig carrier includes a top portion 305 and a bottom portion 310 rotatably coupled by a living hinge 320. Optional enclosures 330 provide locations within the eCig carrier for additional ecigs, eCig components, and eCig accessories. ECig enclosure 325 is accessible via retention feature 335 (as shown in FIG. 3D) when control 340 is linearly manipulated towards the retention feature 335. As the control is coupled to trolley 356 which holds the eCig within the eCig enclosure 325, the linear manipulation of the control drives the trolley toward the retention feature 335 and the eCig through access window 336 (as shown in FIG. 3D). A user may use the control, in conjunction with the trolley and access window, to both extract and retract the eCig relative to the eCig enclosure 325. When the trolley and retention feature are retracted, the retention feature 335 covers the access window 336 to the eCig enclosure.

It is to be understood that retention feature 335 can take a number of forms. For example, the retention feature can be compliant and include one or more portions for allowing access to an eCig within eCig enclosure 325 (see, e.g., FIG. 2D). In other embodiments, the retention feature can be non-compliant and coupled to the eCig carrier 300 by a spring-loaded hinge. The spring-loaded hinge allows the retention feature 335 to rotate open and to allow for an eCig to pass through, in response to the eCig exerting a force on the retention feature greater than the force exerted on the retention feature by the spring. In the present embodiment, however, the retention feature 335 is coupled to access mechanism 355 and control 340. In response to the actuation of the control, the access mechanism and retention feature are linearly actuated, causing the retention feature to extend from the eCig carrier and allowing an eCig within the eCig carrier to extend therefrom.

FIG. 3E is a cross-sectional front view of an eCig carrier 300 of FIG. 3A, with an eCig 350 partially enclosed therein. In response to a linear manipulation of a control 340 toward the access window 336, a trolley 356 coupled to the control is similarly manipulated. In the present embodiment, the retention feature 335 is coupled to the trolley via tether 337. When the trolley contains an eCig, the eCig, in response to the linear travel of the trolley, extends out of an access window 336. In response to the linear manipulation of the control 340, the tether pulls/pushes the retention feature into and out of the access window, allowing the eCig within the eCig carrier 300 to enter and exit the eCig enclosure 325.

Figure 3F:
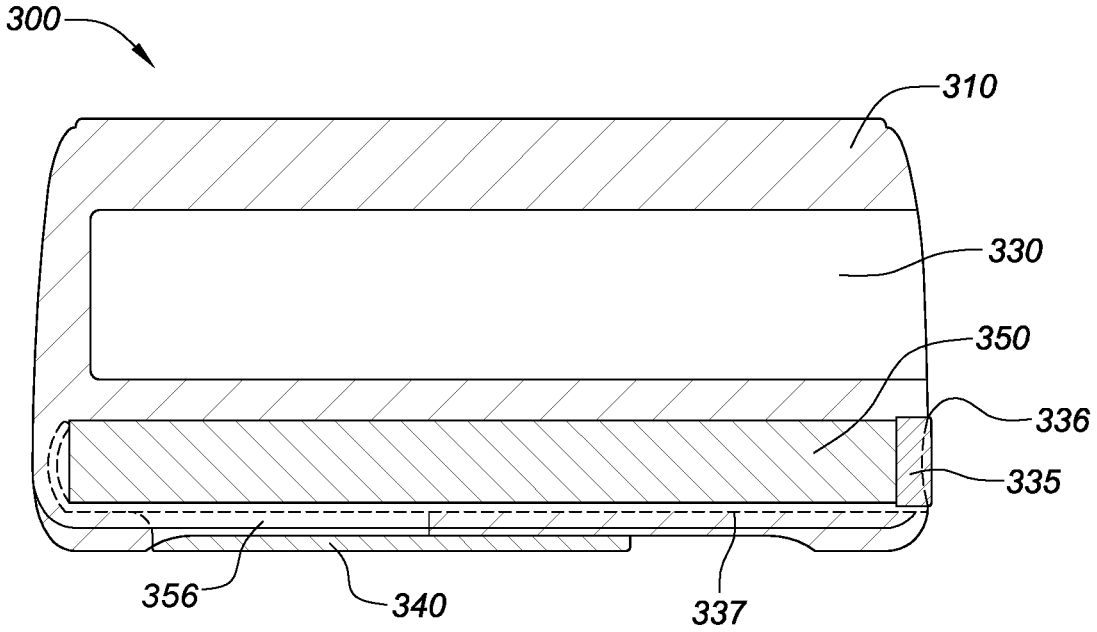
FIG. 3F is a cross-sectional front view of the electronic cigarette carrier of FIG. 3A with an electronic cigarette enclosed therein, consistent with various aspects of the present disclosure.

FIG. 3F is a cross-sectional front view of electronic cigarette carrier 300 of FIG. 3A with an electronic cigarette 350 enclosed therein. A linear manipulation of the control 340 away from the access window 336 draws an eCig, seated in trolley 356, fully into the eCig enclosure 325. Moreover, the linear manipulation simultaneously draws the retention feature 335 into the access window to enclose the eCig within the eCig enclosure 325 via tether 337.

Figure 4A:
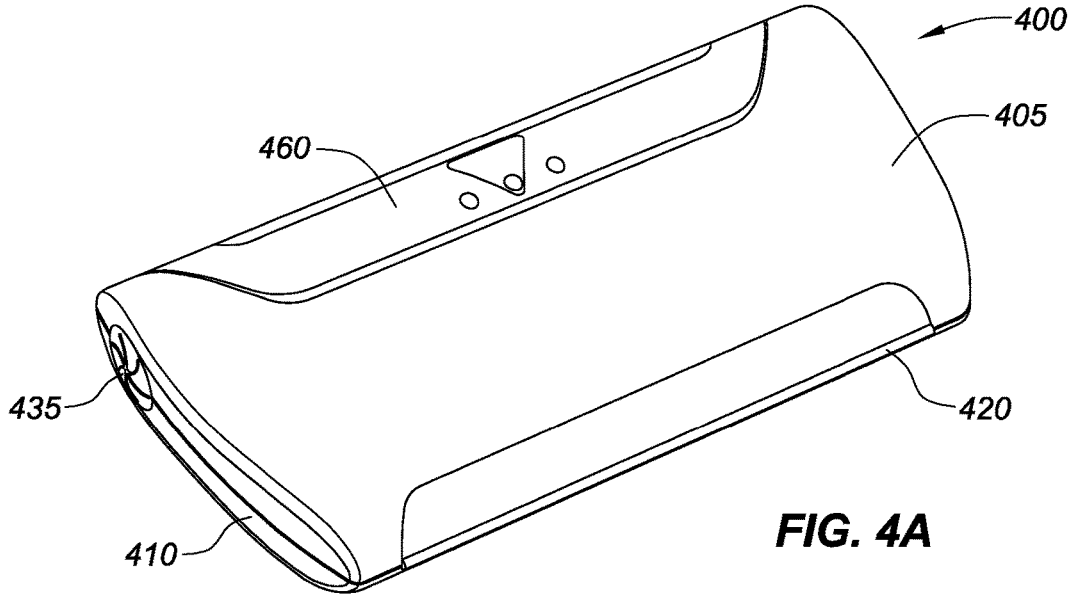
FIG. 4A is an isometric view of a third embodiment of an electronic cigarette carrier, consistent with various aspects of the present disclosure.
Figure 4B:
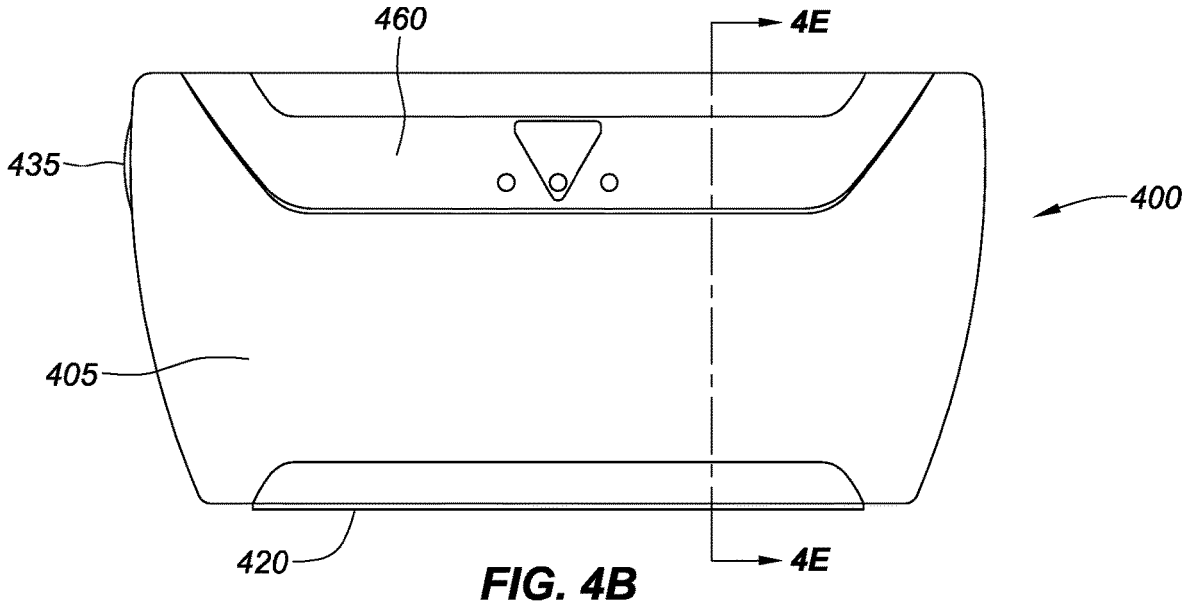
FIG. 4B is a front view of the electronic cigarette carrier of FIG. 4A, consistent with various aspects of the present disclosure.
Figure 4C:
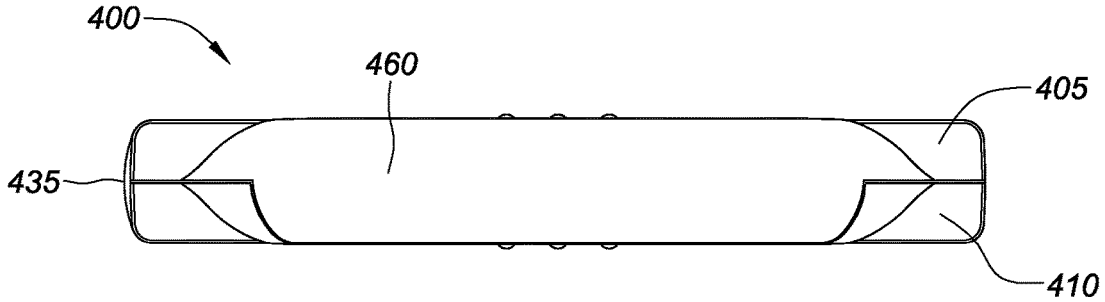
FIG. 4C is a side view of the electronic cigarette carrier of FIG. 4A, consistent with various aspects of the present disclosure.
Figure 4D:
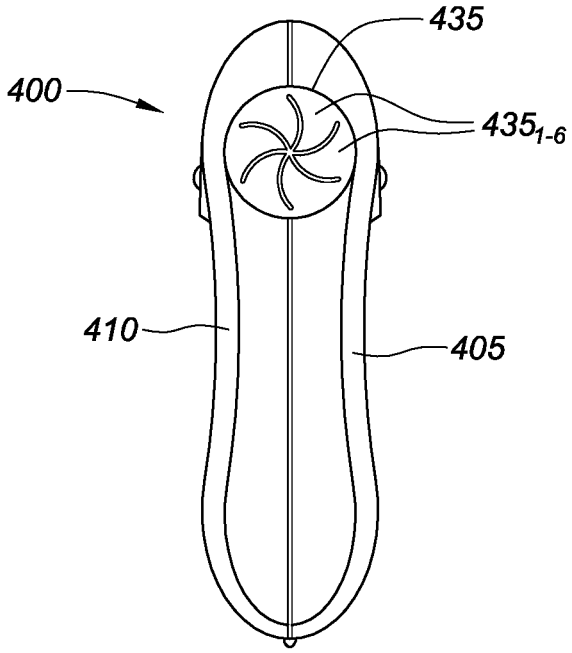
FIG. 4D is a top view of the electronic cigarette carrier of FIG. 4A, consistent with various aspects of the present disclosure.

FIGS. 4A, 4B, 4C, and 4D show an electronic cigarette carrier 400, consistent with various aspects of the present disclosure. The eCig carrier 400 includes a top portion 405 and a bottom portion 410 rotatably coupled to one another via a hinge 420. A retention feature 435 between the top and bottom portions provide access to an eCig within the eCig carrier that is held in place by an impact-driven friction release system. In many embodiments, the impact-driven friction release system functions, in conjunction with the retention feature 435, to prevent the eCig from exiting the eCig carrier below a minimum threshold escape force. The impact-driven friction release system 460, discussed in more detail below, is controlled by a release. As shown in FIG. 4D, the retention feature can include multiple retention portions $\mathbf{435}_{1\text{-}6}$ that act together to both enclose eCig enclosure 425, and deform in response to the eCig being accessed. The multiple retention portions may extend from an outer circumference of the eCig enclosure and take any number of shapes. In the present embodiment, the multiple retention features form a spiral-shape as each retention feature extends to a center of the eCig enclosure 425.

Figure 4E:
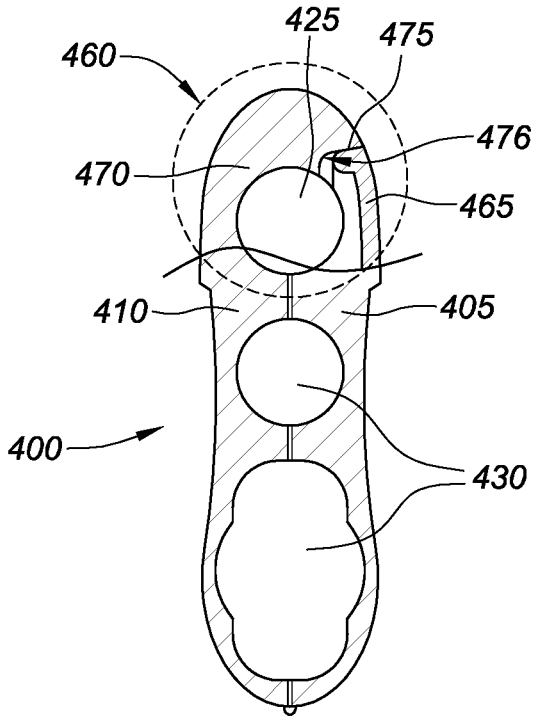
FIG. 4E is a cross-sectional top view of the electronic cigarette carrier of FIG. 4A, consistent with various aspects of the present disclosure.

FIG. 4E is a cross-sectional top view of electronic cigarette carrier 400 of FIG. 4A. The eCig carrier utilizes an impact-driven friction release system 460 to reduce a force holding the eCig within eCig enclosure 425. For example, the impact-driven friction release system can reduce the amount of coupling force exerted on the eCig, in response to an external force of at least a minimum threshold on the impact-driven friction release system. In other embodiments, the impact-driven friction release system can reduce the amount of surface area in contact with the eCig thereby reducing the coefficient of static friction, in response to an external force of at least a minimum threshold on the release. In yet further embodiments, a combination of reduced force and reduced surface area contact can be utilized to release the eCig from the eCig enclosure.

As shown in FIG. 4E, a dislodging member 465 and a dislodged member 470 of the impact-driven friction release system 460 (also referred to as the release system) surrounds at least a portion of an eCig enclosure 425. The dislodging and dislodged members interface along interface 475. When an external compressive force is exerted upon the release system, the dislodging and dislodged members of the release system contact one another at the interface. The larger the compressive force exerted on the release system, the larger the displacement of the dislodging member relative to the dislodged member. As the dislodging member is displaced relative to the dislodged member, the interface moves along a ramp 476 of the dislodged member, which in turn lifts the dislodged member relative to the dislodging member. The lifting of the dislodged member disengages a portion of the dislodged member from an outer surface of the eCig within the eCig enclosure 425 (and/or reduces the amount of compression force exerted upon the eCig by the dislodging and dislodged members). Accordingly, the frictional force exerted on the eCig by the release system is reduced, due at least in part to the reduced surface area in contact with the eCig, thereby allowing the eCig to freely slide within the eCig enclosure and to exit through retention feature 435 (as shown in FIG. 4D). The present embodiment can further include enclosures 430 which provide locations within the eCig carrier 400 for additional ecigs, eCig components, and eCig accessories.

Figure 5:
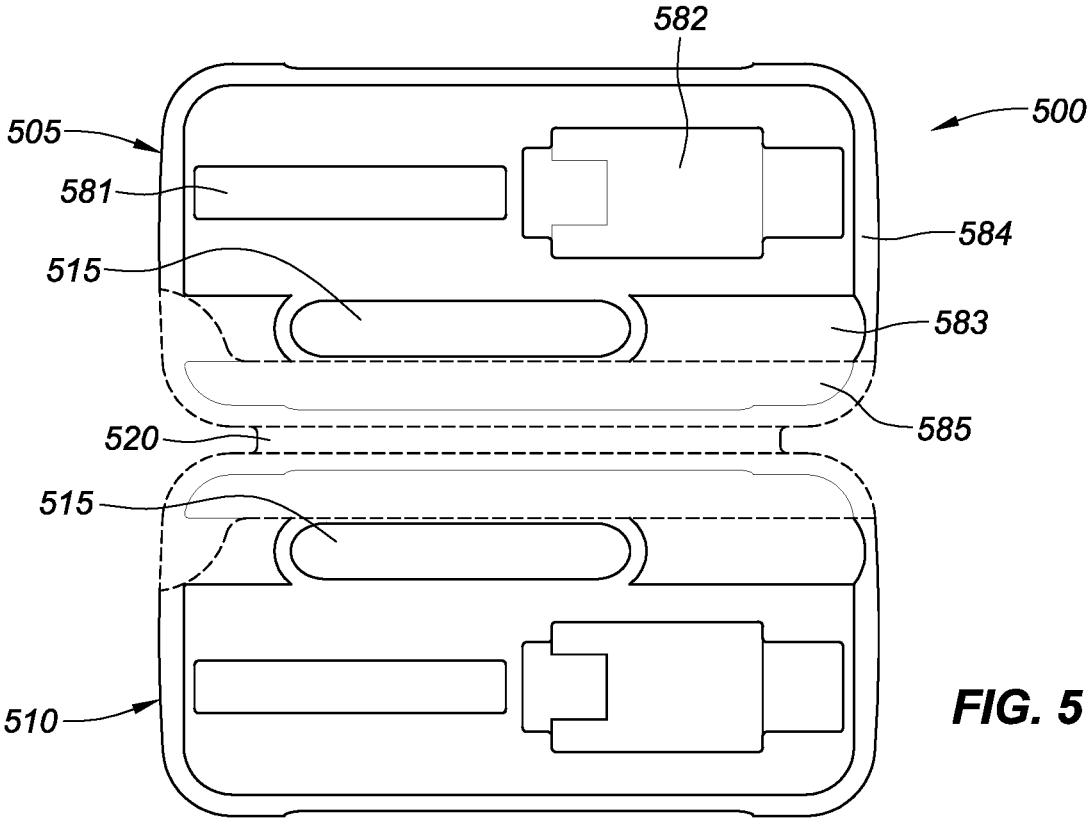
FIG. 5 is a top view of an open electronic cigarette carrier, consistent with various aspects of the present disclosure.

FIG. 5 is a top view of an open electronic cigarette carrier 500, consistent with various aspects of the present disclosure. The electronic cigarette carrier includes a top portion 505 and a bottom portion 510 rotatably coupled to one another via a living hinge 520, and an external manipulation access window 515. A cartomizer enclosure 581, charger enclosure 582, and eCig enclosure 583 allow for the secure storage of an eCig, eCig components, and eCig accessories when the top and bottom portions of the eCig carrier are secured to one another. To protect the eCig, eCig components, and eCig accessories within the eCig carrier, the top and bottom portions can contain a high durometer material 584 which absorbs impacts externally applied to the eCig carrier 500. The living hinge 520, in order to function as a hinge for the top and bottom portions, contains a lower durometer material 585 which facilitates flexing. Accordingly, the eCig carrier is endowed with the desired localized material characteristics, while enabling a single piece clamshell design.

Figure 6:
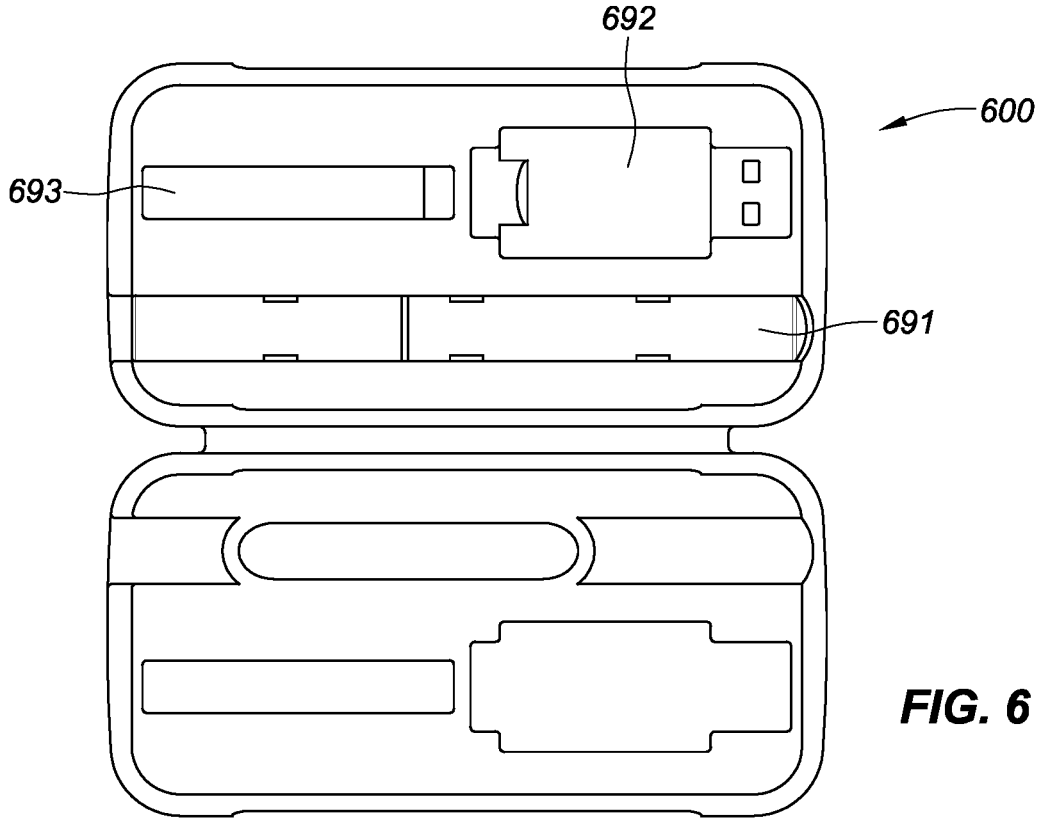
FIG. 6 is a top view of an open electronic cigarette carrier with an electronic cigarette, cartomizer, and charger therein, consistent with various aspects of the present disclosure.

FIG. 6 is a top view of an open electronic cigarette carrier 600, with an electronic cigarette 691, cartomizer 693, and charger 692 therein, consistent with various aspects of the present disclosure. When the eCig carrier is closed, the electronic cigarette 691, cartomizer 693, and charger 692 are protected from damage while being transported by the user.

Various embodiments of the present disclosure are directed to an electronic cigarette carrier for enclosing, and accessing an electronic cigarette. The electronic cigarette carrier includes an electronic cigarette enclosure, a retention feature, and an external manipulation access window. The electronic cigarette enclosure extends from within the electronic cigarette carrier to an exterior surface, and encloses the electronic cigarette therein. The retention feature is releasibly coupled to an exterior surface of the electronic cigarette carrier adjacent the electronic cigarette enclosure, and deforms in response to the internal manipulation of the electronic cigarette into contact with the retention feature. The retention feature encloses a portion of the electronic cigarette enclosure when the electronic cigarette is retracted into the electronic cigarette enclosure. The external manipulation access window extends between the exterior surface of the electronic cigarette carrier and the electronic cigarette enclosure, and allows for access to and external manipulation of the electronic cigarette within the electronic cigarette enclosure—thereby extending the electronic cigarette through the doorway.

In one aspect, a retention feature can deform, and allow access to an electronic cigarette enclosure in response to an external manipulation of an electronic cigarette into contact with the retention feature.

In another aspect an electronic cigarette enclosure further includes a top portion, a bottom portion, and a hinge. The hinge rotatably couples the top and bottom portions of the electronic cigarette enclosure, and provides an alternative access means to the electronic cigarette enclosed within the electronic cigarette enclosure. Further aspects are directed to an external manipulation access window that extends coaxially relative to a length of the electronic cigarette enclosed by the electronic cigarette enclosure.

In one embodiment, a retention feature includes one or more compliant portions which deform in response to an electronic cigarette being accessed.

Further provided is a system for enclosing and accessing an electronic cigarette including an electronic cigarette carrier, a retention feature, and an access mechanism. The electronic cigarette carrier includes an electronic cigarette enclosure, and an opening extending between the electronic cigarette enclosure and an exterior surface of the electronic cigarette carrier. The retention feature, coupled to the electronic cigarette carrier, and in conjunction with the electronic cigarette enclosure encloses the electronic cigarette within the electronic cigarette enclosure. The access mechanism actuates the retention feature, extends the electronic cigarette from out of the electronic cigarette enclosure through the opening and past the actuated retention feature, and retracts the retention feature.

A system for enclosing and accessing an electronic cigarette may include a control coupled to the external surface of the electronic cigarette carrier, and which activates the access mechanism. In further embodiments, the access mechanism can receive the electronic cigarette into the electronic cigarette enclosure. In more specific embodiments, the access mechanism receives the electronic cigarette into the electronic cigarette enclosure by actuating the retention feature, retracting the electronic cigarette into the electronic cigarette enclosure through the opening, and retracting the retention feature to enclose the electronic cigarette within the electronic cigarette enclosure. In one embodiment of the control, the control is linearly actuated by an external force, thereby activating the access mechanism to provide access to the electronic cigarette within the electronic cigarette enclosure. In another embodiment, the control is coupled to an external surface of the electronic cigarette carrier, activates the access mechanism by the application of an external force on the control, and provides access to the electronic cigarette within the electronic cigarette enclosure by releasing the top and bottom portions of the electronic cigarette carrier relative to the hinge.

In one embodiment consistent with various aspects of the present disclosure, an electronic cigarette carrier includes a top portion and a bottom portion, and a hinge rotatably coupling the top portion to the bottom portion. The hinge provides an alternative access means to an electronic cigarette enclosed within the electronic cigarette enclosure. In another aspect of the disclosure, a retention feature may include a compliant material that deforms in response to an access mechanism extending the electronic cigarette out of the electronic cigarette enclosure.

In various embodiments, in response to a first linear manipulation of a control, an access mechanism simultaneously extends the retention feature covering the opening in the electronic cigarette carrier and extends the electronic cigarette through the opening. In more specific embodiments, in response to a second linear manipulation of the control, in a direction opposite to the first linear manipulation, the access mechanism retracts the electronic cigarette through the opening and into the electronic cigarette enclosure, and retracts the retention feature.

Aspects of the present disclosure are also directed to an electronic cigarette carrier for enclosing, and accessing an electronic cigarette. In one embodiment, the electronic cigarette carrier includes a top portion including a compliant material, a bottom portion, an interface, and an opening. The bottom portion including a non-compliant material that is less complaint that the complaint material of the top portion. The top and bottom portions form an electronic cigarette enclosure, and frictionally couples the electronic cigarette to the electronic cigarette enclosure. The interface between the top and bottom portions extends coaxially with a length of the electronic cigarette enclosure. The opening extends from an end of the electronic cigarette enclosure to an exterior surface of the electronic cigarette carrier. In response to a first compression force applied transverse to a plane of the interface, the interface directs the first force across the interface, deforming the top portion relative to the bottom portion, and thereby reducing the frictional coupling between the electronic cigarette and the electronic cigarette enclosure and releasing the electronic cigarette from the electronic cigarette enclosure via the opening.

In one embodiment of the present disclosure, an electronic cigarette carrier may include a hinge that axially couples top and bottom portions, opposite an interface. The hinge, in response to a force, rotates the top and bottom portions coaxially relative to the hinge. In further embodiments, the top and bottom portions, in response to the application of a second tensile force transverse to an axis of the interface, rotatably release the top and bottom portions relative to the hinge—thereby providing an alternative access means to the electronic cigarette enclosed within the electronic cigarette enclosure.

In yet another embodiment consistent with the present disclosure, an electronic cigarette carrier includes a retention feature releasibly coupled to an external surface of the electronic cigarette carrier adjacent an opening therein. The retention feature provides access to the electronic cigarette by deforming in response to an external force placing the electronic cigarette into contact with the retention feature. The retention feature returns to its natural state, enclosing the electronic cigarette enclosure, after the external force has dissipated.

Expressed in other words, it is provided an electronic cigarette carrier for enclosing and accessing an electronic cigarette. The electronic cigarette carrier comprises an electronic cigarette enclosure that extends from within the electronic cigarette carrier to an exterior surface, the electronic cigarette enclosure configured and arranged to enclose the electronic cigarette therein. Furthermore, the electronic cigarette comprises a retention feature releasibly coupled to an exterior surface of the electronic cigarette carrier adjacent the electronic cigarette enclosure, the retention feature configured and arranged to deform in response to the internal manipulation of the electronic cigarette into contact with the retention feature, and enclose a portion of the electronic cigarette enclosure when the electronic cigarette is retracted into the electronic cigarette enclosure. Furthermore, the electronic cigarette carrier comprises an external manipulation access window extending between the exterior surface of the electronic cigarette carrier and the electronic cigarette enclosure, the external manipulation access window configured and arranged to allow for access to and external manipulation of the electronic cigarette within the electronic cigarette enclosure, thereby extending the electronic cigarette through the doorway.

Preferably, the retention feature is configured and arranged to deform, and allow access to the electronic cigarette enclosure in response to an external manipulation of the electronic cigarette into contact with the retention feature.

Moreover preferred, the electronic cigarette enclosure further includes a top portion, a bottom portion, and a hinge, the hinge rotatably coupling the top and bottom portions of the electronic cigarette enclosure, and is configured and arranged to provide an alternative access means to the electronic cigarette enclosed within the electronic cigarette enclosure.

In a preferred embodiment, the external manipulation access window extends coaxially relative to a length of the electronic cigarette enclosed by the electronic cigarette enclosure.

Preferably, the retention feature includes one or more compliant portions, the one or more compliant portions configured and arranged to deform in response to an electronic cigarette being accessed.

Moreover, it is provided a system for enclosing and accessing an electronic cigarette. The system comprises an electronic cigarette carrier including an electronic cigarette enclosure, and an opening extending between the electronic cigarette enclosure and an exterior surface of the electronic cigarette carrier. Furthermore, the system comprises a retention feature, coupled to the electronic cigarette carrier, and configured and arranged with the electronic cigarette enclosure to enclose the electronic cigarette within the electronic cigarette enclosure. An access mechanism configured and arranged to actuate the retention feature, extend the electronic cigarette from out of the electronic cigarette enclosure through the opening and past the actuated retention feature, and retract the retention feature.

Preferably, the system further includes a control coupled to the external surface of the electronic cigarette carrier, the control configured and arranged to activate the access mechanism.

In a preferred embodiment, the access mechanism is further configured and arranged to receive the electronic cigarette into the electronic cigarette enclosure.

Furthermore preferred, the access mechanism is configured and arranged to receive the electronic cigarette into the electronic cigarette enclosure by actuating the retention feature, retracting the electronic cigarette into the electronic cigarette enclosure through the opening, and retracting the retention feature to enclose the electronic cigarette within the electronic cigarette enclosure.

Preferably, the electronic cigarette carrier further includes a top portion and a bottom portion, and a hinge rotatably coupling the top portion to the bottom portion, the hinge configured and arranged to provide an alternative access means to the electronic cigarette enclosed within the electronic cigarette enclosure.

Preferably, the retention feature includes a compliant material configured and arranged to deform in response to the access mechanism extending the electronic cigarette out of the electronic cigarette enclosure.

In a preferred embodiment, the control is configured and arranged to be linearly actuated by an external force, thereby activating the access mechanism to provide access to the electronic cigarette within the electronic cigarette enclosure.

Preferably, the system further includes a control coupled to an external surface of the electronic cigarette carrier, the control configured and arranged to activate the access mechanism by the application of an external force on the control, and provide access to the electronic cigarette within the electronic cigarette enclosure by releasing the top and bottom portions of the electronic cigarette carrier relative to the hinge.

In a preferred embodiment, in response to a first linear manipulation of the control, the access mechanism is configured and arranged to simultaneously extend the retention feature covering the opening in the electronic cigarette carrier and extend the electronic cigarette through the opening.

Furthermore preferred, in response to a second linear manipulation of the control, in a direction opposite to the first linear manipulation, the access mechanism is further configured and arranged to retract the electronic cigarette through the opening and into the electronic cigarette enclosure, and retract the retention feature.

Moreover, it is provided an electronic cigarette carrier for enclosing, and accessing an electronic cigarette. The electronic cigarette carrier comprises a top portion including a compliant material and a bottom portion including a non-compliant material that is less compliant than the compliant material of the top portion. The top and bottom portions form an electronic cigarette enclosure, and are configured and arranged to frictionally couple the electronic cigarette to the electronic cigarette enclosure. Furthermore, the electronic cigarette carrier comprises an interface between the top and bottom portions that extends coaxially with a length of the electronic cigarette enclosure. Moreover, the electronic cigarette carrier comprises an opening that extends from an end of the electronic cigarette enclosure to an exterior surface of the electronic cigarette carrier. The top and bottom portions, and the interface are configured and arranged, in response to a first compression force applied transverse to a plane of the interface, to direct the first force across the interface, deforming the top portion relative to the bottom portion, and thereby reducing the frictional coupling between the electronic cigarette and the electronic cigarette enclosure and releasing the electronic cigarette from the electronic cigarette enclosure via the opening.

Preferably, the electronic cigarette carrier further includes a hinge that axially couples the top and bottom portions, opposite the interface, the hinge configured and arranged to rotate the top and bottom portions coaxially relative to the hinge.

In a preferred embodiment, the top and bottom portions are further configured and arranged, in response to the application of a second tensile force transverse to an axis of the interface, to rotatably release the top and bottom portions relative to the hinge, and thereby provide an alternative access means to the electronic cigarette enclosed within the electronic cigarette enclosure.

Moreover preferred, the electronic cigarette carrier further includes a retention feature releasibly coupled to an external surface of the electronic cigarette carrier adjacent the opening, the retention feature configured and arranged to provide access to the electronic cigarette by deforming in response to an external force placing the electronic cigarette into contact with the retention feature, and returning to its natural state to enclose the electronic cigarette enclosure after the external force has dissipated.

It should be noted that the features illustrated in the drawings are not necessarily drawn to scale, and features of one embodiment may be employed with other embodiments as the skilled artisan would recognize, even if not explicitly stated herein. Descriptions of well-known components and processing techniques may be omitted so as to not unnecessarily obscure the embodiments of the disclosure. The examples used herein are intended merely to facilitate an understanding of ways in which the disclosure may be practiced and to further enable those of skill in the art to practice the embodiments of the disclosure. Accordingly, the examples and embodiments herein should not be construed as limiting the scope of the disclosure. Moreover, it is noted that like reference numerals represent similar parts throughout the several views of the drawings.

The terms "including," "comprising" and variations thereof, as used in this disclosure, mean "including, but not limited to," unless expressly specified otherwise.

The terms "a," "an," and "the," as used in this disclosure, means "one or more," unless expressly specified otherwise.

Although process steps, method steps, algorithms, or the like, may be described in a sequential order, such processes, methods and algorithms may be configured to work in alternate orders. In other words, any sequence or order of steps that may be described does not necessarily indicate a requirement that the steps be performed in that order. The steps of the processes, methods or algorithms described herein may be performed in any order practical. Further, some steps may be performed simultaneously.

When a single device or article is described herein, it will be readily apparent that more than one device or article may be used in place of a single device or article. Similarly, where more than one device or article is described herein, it will be readily apparent that a single device or article may be used in place of the more than one device or article. The functionality or the features of a device may be alternatively embodied by one or more other devices which are not explicitly described as having such functionality or features.

LIST OF REFERENCE SIGNS

| | |
|---|---|
| 10 | electronic smoking device |
| 12 | end cap |
| 14 | power supply portion |
| 16 | atomizer/liquid reservoir portion |
| 15 | external manipulation access window |
| 18 | light-emitting diode (LED) |
| 20 | air inlets |
| 22 | battery |
| 24 | control electronics |
| 26 | airflow sensor |
| 28 | atomizer |
| 30 | heating coil |
| 32 | wick |
| 34 | central passage |
| 36 | liquid reservoir |
| 38 | air inhalation port |
| 200 | eCig carrier |
| 205 | top portion |
| 210 | bottom portion |
| 215 | external manipulation access window |
| 216 | grip |
| 220 | living hinge |
| 225 | eCig enclosure |
| 230 | enclosure |
| 235 | gate |
| 300 | eCig carrier |
| 305 | top portion |
| 310 | bottom portion |
| 320 | hinge |
| 325 | eCig enclosure |
| 330 | enclosure |
| 335 | retention feature |
| 336 | access window |
| 337 | tether |
| 340 | control |
| 350 | eCig |
| 355 | access mechanism |
| 356 | trolley |
| 400 | eCig carrier |
| 405 | top portion |
| 410 | bottom portion |
| 420 | hinge 425 eCig enclosure |
| 430 | enclosure |
| 435 | retention feature |
| 460 | impact-driven friction release system |
| 465 | dislodging member |
| 470 | dislodged member |
| 475 | interface |
| 476 | ramp |
| 500 | eCig carrier |
| 505 | top portion |
| 510 | bottom portion |
| 515 | window |
| 520 | living hinge |
| 581 | cartomizer enclosure |
| 582 | charger enclosure |
| 583 | eCig enclosure |
| 584 | high durometer material |
| 585 | low durometer material |
| 600 | eCig carrier |
| 605 | top portion |
| 610 | bottom portion |
| 615 | external manipulation access window |
| 620 | living hinge |
| 691 | electronic cigarette |
| 692 | cartomizer |
| 693 | charger |

What is claimed is:

1. An electronic cigarette carrier for enclosing, and accessing an electronic cigarette, the electronic cigarette carrier comprising:

an electronic cigarette enclosure that extends from within the electronic cigarette carrier to an exterior surface, the electronic cigarette enclosure configured and arranged to enclose the electronic cigarette therein;

an interface formed along a length of the electronic cigarette enclosure, the interface configured and arranged, in response to a first compression force applied transverse to a plane of the interface, to direct the first compression force across the interface, thereby deforming a portion of the electronic cigarette enclosure that is configured to reduce the frictional coupling between the electronic cigarette and the electronic cigarette enclosure, and allowing a user to extract the electronic cigarette from the electronic cigarette enclosure; and a retention feature coupled to the exterior surface of the electronic cigarette carrier adjacent the electronic cigarette enclosure, the retention feature configured and arranged to deform in response to contact with the electronic cigarette, the deformation facilitating extraction of the electronic cigarette from the electronic cigarette enclosure; and wherein the retention feature is configured to actuate when the electronic cigarette is inserted into the electronic cigarette carrier and enclose a portion of the electronic cigarette enclosure when the electronic cigarette is retracted into the electronic cigarette enclosure.

2. The electronic cigarette carrier of claim 1, wherein the retention feature includes one or more compliant portions, the one or more compliant portions configured and arranged to deform in response to the electronic cigarette being accessed.

3. The electronic cigarette carrier of claim 1, wherein the electronic cigarette carrier further includes a top portion and a bottom portion on either side of the interface, and a hinge;

wherein the top and bottom portions form the electronic cigarette enclosure; and wherein the hinge rotatably couples the top and bottom portions and is opposite the interface.

4. The electronic cigarette carrier of claim 3, wherein the top and bottom portions are further configured and arranged, in response to the application of a second tensile force transverse to an axis of the interface, to rotatably release the top and bottom portions relative to the hinge, and thereby provide the alternative access means to the electronic cigarette enclosed within the electronic cigarette enclosure.

5. The electronic cigarette carrier of claim 1, wherein the retention feature is releasably coupled to the exterior surface of the electronic cigarette carrier adjacent the electronic cigarette enclosure, the retention feature is further configured and arranged to provide access to the electronic cigarette by deforming in response to an external force placing the electronic cigarette into contact with the retention feature, and returning to its natural state to enclose the electronic cigarette enclosure after the external force has dissipated.

6. A system for enclosing and accessing an electronic cigarette comprising:

an electronic cigarette; and an electronic cigarette carrier including a top portion comprising a compliant material, a bottom portion comprising a non-compliant material that is less compliant than the compliant material of the top portion, and an electronic cigarette enclosure formed between the top and bottom portions, and an opening extending between the electronic cigarette enclosure and a first exterior surface of the electronic cigarette carrier;

an access mechanism formed by the top and bottom portions, the access mechanism configured and arranged to frictionally couple the electronic cigarette to the electronic cigarette enclosure, and in response to a first compression force applied transverse to an interface of the top and bottom portions of the electronic cigarette enclosure, the top portion deforms relative to the bottom portion reducing the frictional coupling between the electronic cigarette and the electronic cigarette enclosure, allowing the electronic cigarette to exit the electronic cigarette enclosure via the opening, and further allowing the electronic cigarette to be retracted into the electronic cigarette carrier through the opening.

7. The system of claim 6, wherein the access mechanism includes a control configured and arranged to activate the access mechanism.

8. The system of claim 6, wherein the access mechanism is further configured and arranged to receive the electronic cigarette into the electronic cigarette enclosure.

9. The system of claim 6, wherein the electronic cigarette carrier further includes a hinge rotatably coupling the top portion to the bottom portion, the hinge configured and arranged to provide an alternative access means to the electronic cigarette enclosed within the electronic cigarette enclosure.

10. An electronic cigarette carrier for enclosing, and accessing an electronic cigarette, the electronic cigarette carrier comprising:

an electronic cigarette enclosure that extends from within the electronic cigarette carrier to an exterior surface, the electronic cigarette enclosure configured and arranged to enclose the electronic cigarette therein; and a retention feature coupled to the exterior surface of the electronic cigarette carrier adjacent the electronic cigarette enclosure, the retention feature configured and arranged to deform in response to contact with the electronic cigarette, the deformation facilitating extraction of the electronic cigarette from the electronic cigarette enclosure;

deform in response to contact with the electronic cigarette to facilitate insertion of the electronic cigarette into the electronic cigarette enclosure; and enclose a portion of the electronic cigarette enclosure when the electronic cigarette is retracted into the electronic cigarette enclosure;

a top portion made of a compliant material;

a bottom portion made of a non-compliant material that is less compliant than the compliant material of the top portion;

a hinge rotatably coupling the top and bottom portions; and an interface between the top and bottom portions that extends coaxially with a length of the electronic cigarette enclosure;

wherein the top and bottom portions form the electronic cigarette enclosure, and the top and bottom portions are configured and arranged to frictionally couple the electronic cigarette to the electronic cigarette enclosure;

wherein the top and bottom portions and the interface are configured and arranged, in response to a first compression force applied transverse to a plane of the interface, to direct the first force across the interface thereby deforming the top portion relative to the bottom portion, which is configured to reduce the frictional coupling between the electronic cigarette and the electronic cigarette enclosure, releasing the electronic cigarette from the electronic cigarette enclosure via the retention feature, and further allowing the electronic cigarette to be retracted into the electronic cigarette carrier via the retention feature.

11. The electronic cigarette carrier of claim 10, wherein the hinge is opposite the interface.

12. The electronic cigarette carrier of claim 10, wherein the top and bottom portions are further configured and arranged, in response to the application of a tensile force transverse to an axis of the interface, to rotatably release the top and bottom portions relative to the hinge, and thereby provide the alternative access means to the electronic cigarette enclosed within the electronic cigarette enclosure.

13. The electronic cigarette carrier of claim 10, wherein the retention feature is releasably coupled to the exterior surface of the electronic cigarette carrier adjacent the electronic cigarette enclosure, the retention feature is further configured and arranged to provide access to the electronic cigarette by deforming in response to an external force placing the electronic cigarette into contact with the retention feature, and returning to its natural state to enclose the electronic cigarette enclosure after the external force has dissipated.

* * * * *